US011261663B2

(12) United States Patent
Klimek et al.

(10) Patent No.: US 11,261,663 B2
(45) Date of Patent: Mar. 1, 2022

(54) GATE

(71) Applicant: KLIMEK ENTRY GATES, INC., New Bethlehem, PA (US)

(72) Inventors: Christopher Klimek, Challis, ID (US); Chad Shaffer, New Bethlehem, PA (US)

(73) Assignee: Klimek Entry Gates, Inc., New Bethlehem, PA (US)

( * ) Notice: Subject to any disclaimer, the term of this patent is extended or adjusted under 35 U.S.C. 154(b) by 476 days.

(21) Appl. No.: 16/222,349

(22) Filed: Dec. 17, 2018

(65) Prior Publication Data

US 2019/0186199 A1 Jun. 20, 2019

Related U.S. Application Data

(60) Provisional application No. 62/599,918, filed on Dec. 18, 2017.

(51) Int. Cl.

| | |
|---|---|
| ***E06B 11/02*** | (2006.01) |
| ***E04H 12/22*** | (2006.01) |
| ***E05B 65/00*** | (2006.01) |
| *E05F 1/10* | (2006.01) |

(52) U.S. Cl.

CPC ..... *E06B 11/025* (2013.01); *E04H 12/2269* (2013.01); *E05B 65/0007* (2013.01); *E05F 1/1041* (2013.01); *E05Y 2201/656* (2013.01); *E05Y 2900/40* (2013.01)

(58) Field of Classification Search

CPC .... E06B 11/025; E06B 11/023; E05F 1/1041; E04H 12/2269

USPC ..... 49/49

See application file for complete search history.

(56) References Cited

U.S. PATENT DOCUMENTS

| | | | | | |
|---|---|---|---|---|---|
| 611,608 | A | * | 10/1898 | Compher | |
| 844,964 | A | * | 2/1907 | Singer | |
| 1,234,893 | A | * | 7/1917 | Fridley | F16C 21/00 384/126 |
| 1,253,742 | A | * | 1/1918 | Stedman | E06B 9/063 160/145 |
| 1,543,199 | A | * | 6/1925 | Winebrake | E06B 11/023 160/37 |
| 1,765,217 | A | * | 6/1930 | Ehlers | E06B 11/02 49/105 |

(Continued)

FOREIGN PATENT DOCUMENTS

| | | |
|---|---|---|
| CN | 204045159 | 12/2012 |
| DE | 9201580 | 4/1992 |

(Continued)

*Primary Examiner* — Gregory J Strimbu

(74) *Attorney, Agent, or Firm* — Dentons Cohen & Grigsby P.C.

(57) ABSTRACT

A gate may generally include a gatepost and a plurality of rails pivotally connected to the gatepost and having a plurality of posts hingedly attached to at least one of the plurality of rails. The gate may include a lift system having a translating device in communication with a sprocket, wherein the lift system provides an adjustable force to rotate the plurality of rails from a horizontal position to an upward position. The adjustable force may be provided by a turnbuckle. The gate may include a ground anchor system that allows axial rotation of the plurality of rails about a longitudinal axis of the gatepost.

13 Claims, 10 Drawing Sheets

(56) References Cited

U.S. PATENT DOCUMENTS

| | | | | | |
|---|---|---|---|---|---|
| 2,661,557 | A * | 12/1953 | Reymann | E06B 11/02 | 160/144 |
| 3,638,710 | A * | 2/1972 | Sundermann | E06B 11/02 | 160/144 |
| 4,035,955 | A | 7/1977 | Burnett | | |
| 4,519,164 | A * | 5/1985 | Porter | E06B 11/04 | 49/108 |
| 5,440,838 | A | 8/1995 | Lesser | | |
| 5,622,141 | A * | 4/1997 | Lareva | A01K 1/0029 | 119/843 |
| 6,796,084 | B2 * | 9/2004 | Gagnon | E01F 13/06 | 49/226 |
| 7,000,673 | B2 * | 2/2006 | Cook | E06B 11/02 | 160/210 |
| 8,539,714 | B2 | 9/2013 | Munoz-Cruzado Sanchez | | |
| 2006/0288643 | A1 | 12/2006 | Henshell | | |
| 2012/0011774 | A1 | 1/2012 | Arnaud | | |
| 2012/0067388 | A1 * | 3/2012 | Zummach | E04H 15/58 | 135/96 |

FOREIGN PATENT DOCUMENTS

| | | |
|---|---|---|
| EP | 990736 | 4/2000 |
| GB | 2248482 | 7/1994 |

* cited by examiner

GATE

CROSS REFERENCE TO RELATED APPLICATION

This application claims the benefit of U.S. Provisional Application Ser. No. 62/599,918, filed Dec. 18, 2017, which is incorporated by reference herein in its entirety.

TECHNICAL FIELD

The present invention relates to gates for access control, and in particular to manually operable, vertical opening systems for gates, and gates including the vertical opening systems.

BACKGROUND

Gates are used worldwide to control access for people, animals, and vehicles between areas. For example, ranchers and farmers use gates to control the entry and exit of people and animals from various fields and buildings on a farm or ranch. Conventional gates used to control such access can be categorized into two classes: swing-style gates and vertical-style gates. Swing-style gates open by rotation about a horizontal axis of the gate, and thus require substantially level terrain. This limitation can be problematic in areas where the ground is uneven, such as areas with a ditch or snow accumulation. Moreover, for larger swing-style gates, hinge failure is common due to gravitational pull on the hinges in a path perpendicular to the direction of hinge rotation. Swing-style gates also can require a significant amount of area in front of and/or behind the gate as the gates swings open/closed.

Vertical-style gates open along a vertical axis of the gate, thus eliminating the space in front of and/or behind the gate required during opening and closing the gate. These gates, however, generally maintain a rigid shape when opening, and may therefore take up unnecessary space in the gate opening when in the open position. One solution to this problem is to include pivot points along the gate rails so that it may fold in an accordion-like manner when opening. If damaged by vehicles or livestock, however, these accordion-style gates may fail to open due to the damaged pivot points. Moreover, conventional vertical-style gates are generally heavy, and thus often require motorized assistance to aid in opening.

Both swing-style and vertical-style gates may be operated manually or may be electrically driven. Manually opened swing-style gates necessitate that the operator walk the distance of the swing arc. Manually operated vertical-style gates generally need to be lightweight so that they can be opened using conventional lift mechanisms. Conventional heavy-duty, vertical-style gates may be too heavy for manual operation, and may use weight and cable/pulley systems to facilitate manual opening. Such versions, however, expose the cables to high tensions. Electrically driven gates, on the other hand, automate opening and closing operations, but require a motor and an electric source, which may not be practical to implement in all environments.

Accordingly, more efficient gates and methods of making and using the same are desirable.

SUMMARY

The presently disclosed invention overcomes many of the shortcomings of the prior art by providing more efficient and/or cost-effective vertical-style gates and methods of making and using the same. The gates provide an improved means to control access across a wide opening, such as a roadway, without obscuring the opening and without the need for motorized assistance.

Thus, the present invention is related to a gate comprising a stanchion, and a plurality of rails pivotally connected to the stanchion and comprising a plurality of posts hingedly attached thereto. The gate includes a unique lift system which generally comprises a translating device in communication with a sprocket, wherein the lift system provides an adjustable force to rotate the plurality of rails from a horizontal position to a vertical position. The hinged attachment of the plurality of posts to the plurality of rails allows the posts to fold substantially parallel with the rails when the rails are in the vertical position.

According to certain aspects of the present invention, a first end of at least one of the plurality of rails may include a counterbalance weight. According to certain aspects of the present invention, a second end of the at least one of the plurality of rails may include a remote controllable latch. In some examples, the lift system and/or counterbalance weight may bias the plurality of rails to the vertical position, and the latch may maintain the plurality of rails in the horizontal position when engaged thereon.

According to certain aspects of the present invention, the translating device of the lift system may comprise a first end including a spring fixedly connected to the stanchion, a second end including a chain fixedly connected to one of the plurality of rails, and a middle portion comprising a turnbuckle positioned between, and connected to, the first end and the second end of the translating device. Rotation of the turnbuckle may increase or decrease the adjustable force provided by the lift system.

According to certain aspects of the present invention, the first end of the translating device may be connected proximal to a top end of the stanchion. Moreover, the stanchion may comprise two upright stanchions, and the plurality of rails and the sprocket may be connected between the two upright stanchions.

According to certain aspects of the present invention, the gate may include a housing attachable to the stanchion and configured to enclose the lift system.

According to certain aspects of the present invention, a bottom end of the gatepost may be attachable to a connection plate positioned at ground level. Alternatively, the gate may further include a unique ground anchor system that allows axial rotation of the plurality of rails about the stanchion. Thus, the gate may be configured to operate as both a swing-style gate and a vertical-style gate. The ground anchor system may comprise a first cylindrical element securely attached to a bottom end of the stanchion, and a second cylindrical element sized to rotatably accept the first cylindrical element therein. A portion of the second cylindrical element may be secured below a ground level. The first cylindrical element may include a collar that projects radially outward from an outer surface of the first cylindrical element, and which maintains the stanchion at a specific position within the second cylindrical element and thus a predetermined distance from the ground level, by extending beyond an outer edge of the second cylindrical element.

According to certain aspects of the present invention, the ground anchor system may further include a locking system configured to prevent rotation of the second cylindrical element within the first cylindrical element. The locking system may comprise a pin that traverses the first and second cylindrical elements, and may include a lock to prevent removal and/or theft of the pin.

The present invention is also related to a gate comprising a gatepost (i.e., stanchion) having a plurality of swing arms pivotally connected thereto, and a lift system. The swing arms may comprise a first section and a second section, wherein the second section is offset from the first section and pivotally connected to the gatepost, and wherein the second section comprises one or more segments hingedly attached in series. The first section may comprise a counterbalance weight, such as a weight positioned at an end of the first section of the swing arm distal from the second section thereof. The lift system may comprise a translating device in communication with a sprocket, wherein the lift system provides a force to rotate the plurality of swing arms from a horizontal position to a vertical position and the one or more segments of the second section from an open position to a closed position.

BRIEF DESCRIPTION OF THE DRAWINGS

The various embodiments described herein may be better understood by considering the following description in conjunction with the accompanying drawings. In the following figures, like numerals represent like features in the various views. It is to be noted that features and components in these drawings, illustrating the views of embodiments of the present invention, unless stated to be otherwise, are not necessarily drawn to scale. The illustrative embodiments in the following drawings are not meant to be limiting; other embodiments may be utilized and other changes may be made without departing from the spirit or scope of the subject matter presented herein.

DETAILED DISCUSSION

Figure 1A:
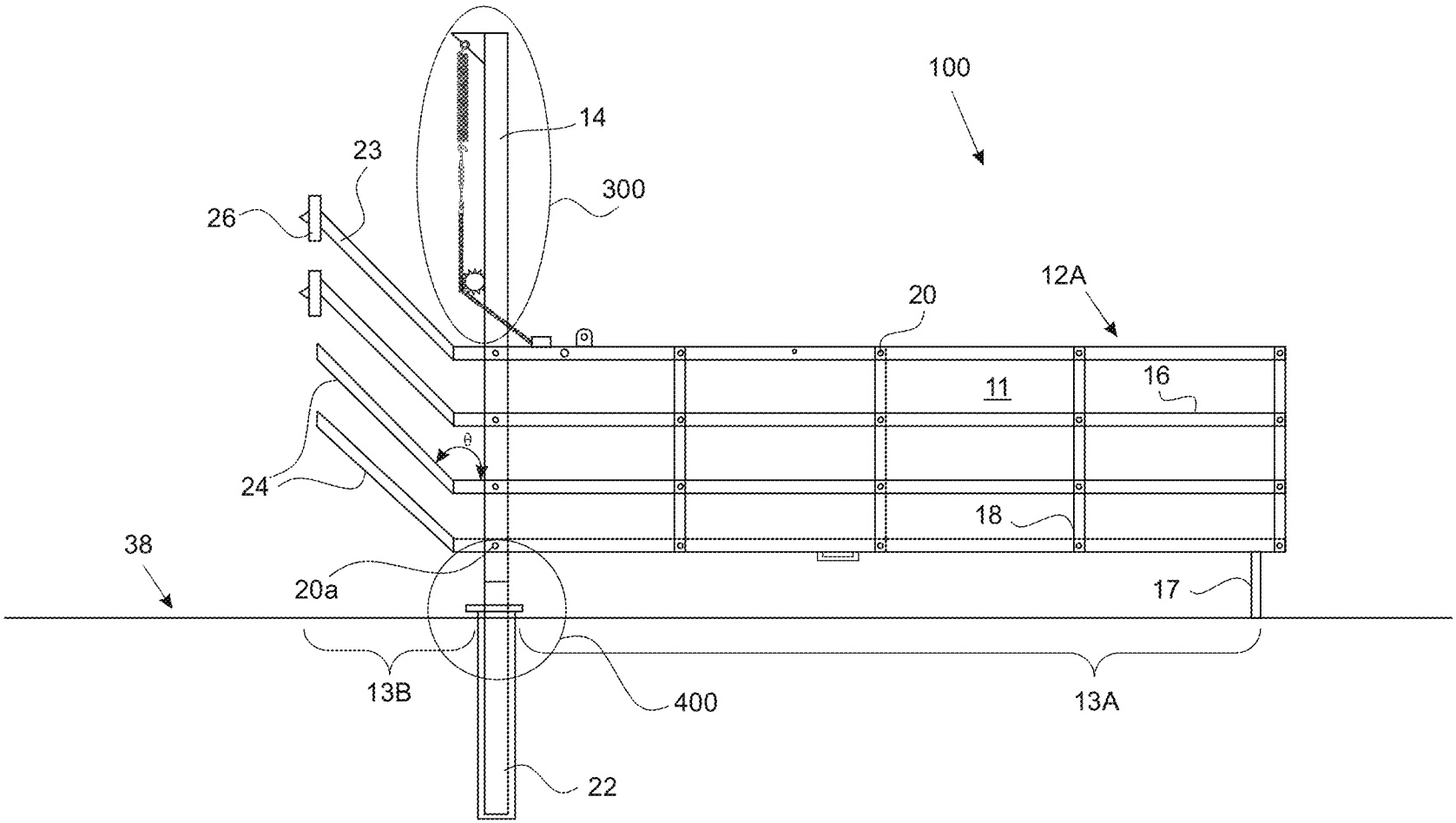
FIG. 1A illustrates a gate according to an embodiment of the invention disclosed herein.

As generally used herein, the articles "one", "a", "an" and "the" refer to "at least one" or "one or more", unless otherwise indicated. Thus, for example, although reference is made to "a" rail, "a" post, "the" ground anchor, one or more of these components and/or any other components described herein can be used.

As generally used herein, the terms "including" and "having" mean "comprising".

Various aspects of the gates disclosed herein may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Further, for purposes of the description hereinafter, the terms "end", "upper", "lower", "right", "left", "vertical", "horizontal", "top", "bottom", "lateral", "longitudinal", and derivatives thereof shall relate to the disclosure as it is oriented in the figures. By way of example, if aspects of the gate shown in the drawings or photographs are turned over, elements described as being on the "bottom" side of the other elements would then be oriented on the "top" side of the other elements as shown in the relevant drawing or photograph. The term "bottom" can therefore encompass both an orientation of "bottom" and "top" depending on the particular orientation of the drawing.

The term "proximal" refers to the direction towards the gatepost or stanchion and away from the end of the gate. The term "distal" refers to the outward direction extending away from the gatepost and toward the end of the gate which may include a latch.

As generally used herein, the term "about" refers to an acceptable degree of error for the quantity measured, given the nature or precision of the measurements. Typical exemplary degrees of error may be within 20%, 10%, or 5% of a given value or range of values. At the very least, and not as an attempt to limit the application of the doctrine of equivalents to the scope of the claims, each numerical parameter should at least be construed in light of the number of reported significant digits and by applying ordinary rounding techniques.

All numerical quantities stated herein are approximate unless stated otherwise. Accordingly, the term "about" may be inferred when not expressly stated. Numerical quantities described in specific examples of actual measured values, however, are reported as precisely as possible.

Any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited in this disclosure is intended to include all lower numerical limitations subsumed therein and any minimum numerical limitation recited in this disclosure is intended to include all higher numerical limitations subsumed therein. Accordingly, Applicants reserve the right to amend this specification, including the claims, to expressly recite any sub-range subsumed within the ranges expressly recited herein.

In the following description, certain details are set forth in order to provide a better understanding of various embodiments of gates. However, one skilled in the art will understand that these embodiments may be practiced without these details and/or in the absence of any details not described herein. In other instances, well-known structures, methods, and/or techniques associated with methods of practicing the various embodiments may not be shown or described in detail to avoid unnecessarily obscuring other details of the various embodiments. As such, it is to be understood that the description set forth herein is merely exemplary and illustrative of the disclosed embodiments and is not intended to limit the scope of the invention as defined solely by the claims.

It is also to be understood that the specific gates and devices considered to be portions of the disclosed gate(s) illustrated in the attached drawings, and described in the following specification, are simply exemplary aspects of the disclosure. Hence, specific dimensions and other physical characteristics related to the aspects disclosed herein are not to be considered as limiting. For the purpose of facilitating understanding of the disclosure, the accompanying drawings and description illustrate aspects thereof, from which the disclosure, various aspects of its structure, construction, and method of operation, and many advantages may be understood and appreciated.

According to certain embodiments, more efficient and/or cost-effective vertical-style gates and methods of making and using the same are described and illustrated in FIGS. 1-12. The gates provide an improved means to control access across a wide opening, such as a roadway, without obscuring the opening and without the need for motorized assistance.

Figure 1B:
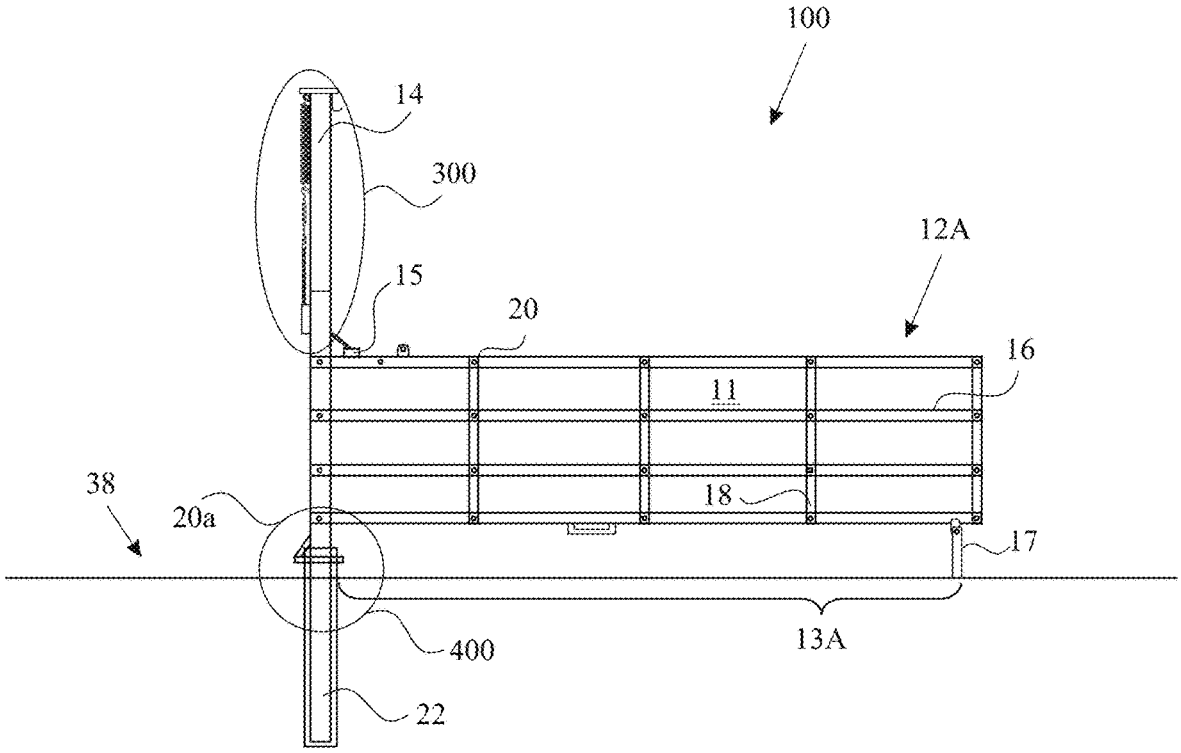
FIG. 1B illustrates a gate according to an embodiment of the invention disclosed herein.
Figure 2:
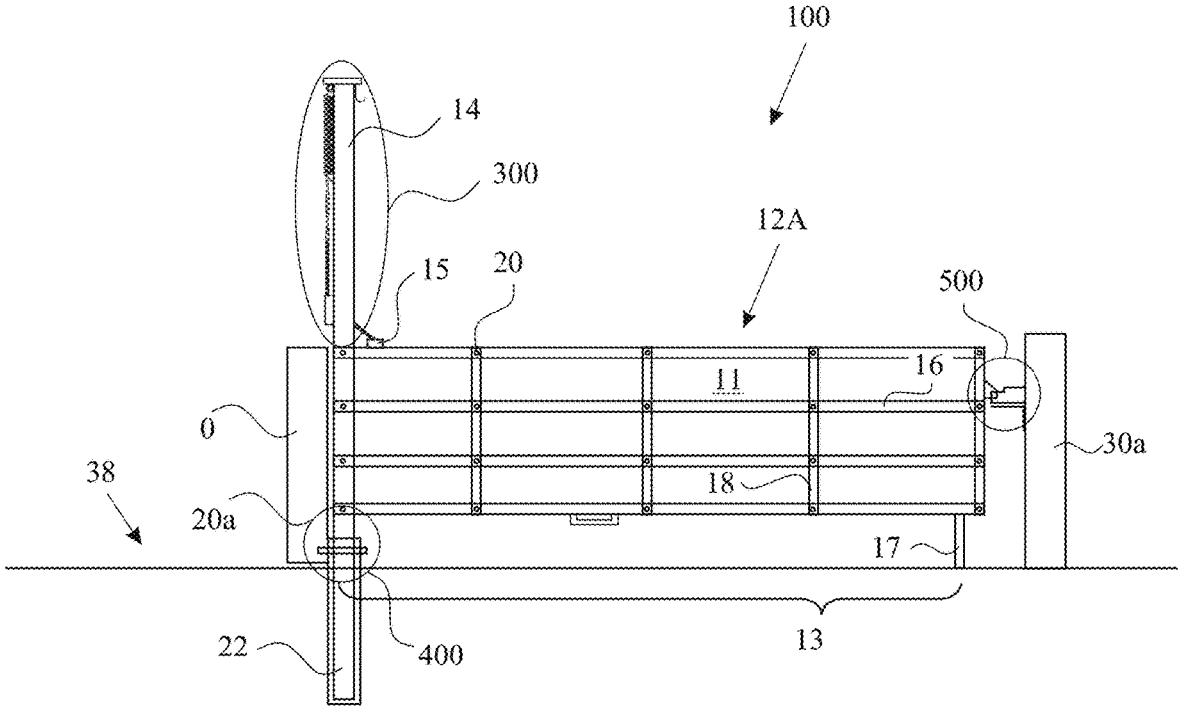
FIG. 2 illustrates a gate according to another embodiment of the invention disclosed herein.

With reference to FIGS. 1A, 1B, and 2, the gate 100 of the present invention may be include a single gate portion 12A supported by a gatepost or stanchion 14 configured to engage the ground 38 in a generally perpendicular manner. The gate portion 12A may include a plurality of swing arms or rails 16 hingedly attached to the stanchion 14, and a plurality of posts 18 hingedly attached to the plurality of rails 16. The hinged attachment of the rails 16 to the stanchion 14 allows the rails 16 to rotate on the stanchion 14 from a horizontal position when closed (as shown in FIG. 2), to a vertical position when open (see for example FIG. 12). Moreover, the hinged attachment of the posts 18 to the rails 16 allows the posts 18 to fold toward the rails 16 to a position parallel with the rails 16 when the gate portion 12A is opened (i.e., when the rails 16 are rotated to a vertical position; see FIG. 12).

Figure 12:
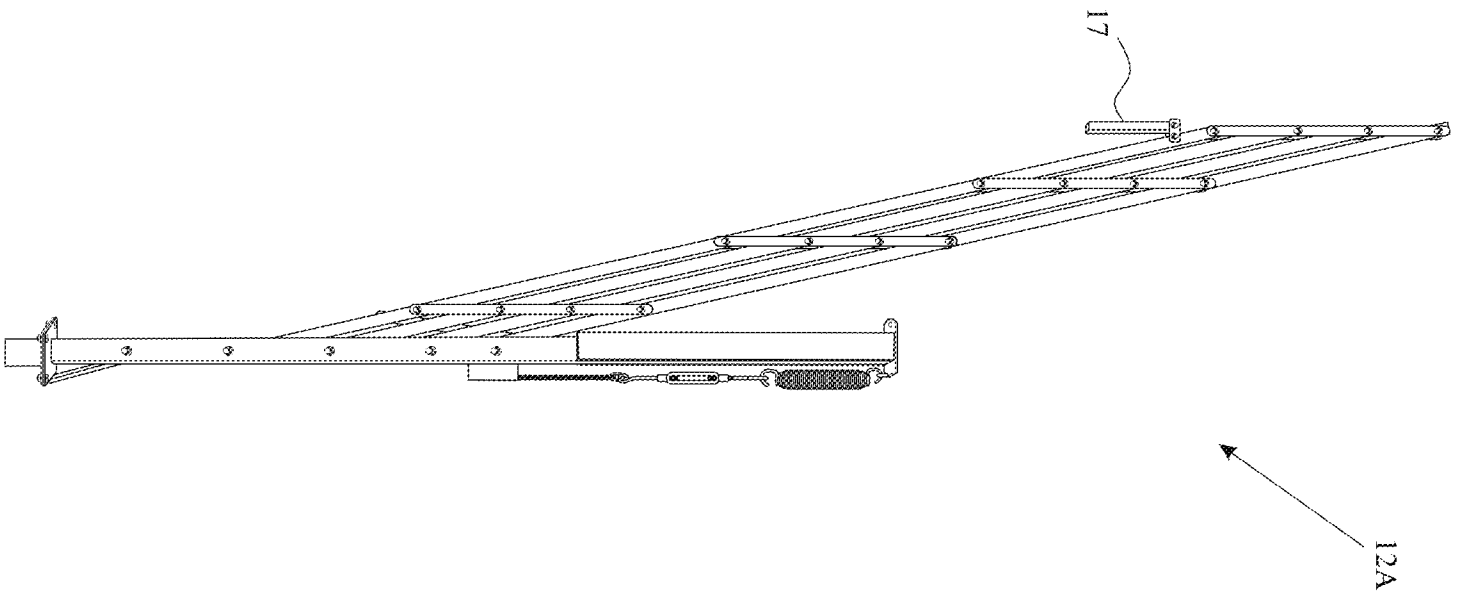
FIG. 12 illustrates the gate shown in FIG. 2 in a fully open position.

Another way of understanding the vertical opening of the gate 100 is to view the plurality of swing arms or rails 16 as comprising one or more segments 11 hingedly attached in series. That is, segments 11 are formed by connection of the plurality of posts 18 to the plurality of rails 16. Opening the gate 100 involves rotating the plurality of rails 16 from a horizontal position, as shown in FIG. 2, to a vertical position, as shown in FIG. 12, and the one or more segments 11 from an open position to a closed position.

The hinged attachment between the posts 18 and rails 16 (pivot points 20), and between the rails 16 and stanchion 14 (pivot points 20*a*), allows rotation about the attachment point so that the connected portions (post to rails, and rails to stanchion) may rotate relative to each other within a plane parallel with the longitudinal axes of the gate portion 12A. The connection between portions, i.e., pivot points 20 and 20*a*, may be by any means known in the art, such as pins, screws, nuts/bolts, etc., and in certain instances may include intervening components, such as washers, nuts, clamps, etc. The pivot points 20 and 20*a* may use the same connection means or different connection means.

According to certain aspects, the gate 100 of the present invention may further include a counterbalance system. For example, one or more of the rails 16 may include an extension 23, which extends past the stanchion 14 on a side opposite from the hingedly attached posts 18 and the distal end of the gate portion 12A. That is, a second section 13B of the gate portion 12A may extend to the left of the stanchion 14 and a first section 13A of the gate portion 12A may extend to the right of the stanchion 14, as shown in FIG. 1A. (This assignment would be opposite if the view in FIG. 1A where flipped horizontally, and is define as left or right of the stanchion for ease of understanding only). Some or all of the rails 16 in the second section 13B, and/or some or all of each extension 23 may be angled 24 with respect to the rails 16 in the first section 13A so that an end of the extensions 23 does not contact the ground 38 when the rails are rotated from the horizontal position to the vertical position (i.e., when the gate 100 is opened). As shown in FIG. 1A, an angle θ is included in all of the extension 23 so that a large portion of the length of the extensions 23 is angled upward with respect to the ground level 38.

Moreover, the counterbalance system may include a counterbalance weight 26 positioned on one or more of the extensions 23 in the second section 13B. The counterbalance weight 26 may be positioned anywhere along the extension 23, such as at an end of the extension 23 as shown in FIG. 1A. The effort required to rotate the gate portion 12A from a closed, horizontal position to an open, vertical position may be lessened by the counterbalance system (i.e., by the extensions 23 alone, or the extensions 23 including the counterbalance weights 26). That is, the perceived weight of the gate portion 12A, and the rate of movement of the gate portion 12A from the horizontal to the vertical position may be controlled by any or all of the length of the extensions 23, the number of counterbalance weights 26 included on the extensions 23, the position of the counterbalance weights 26 on the extensions 23, and the absolute weight of each of the counterbalance weights 26.

According to certain aspects, the gate of the present invention may not include a counterbalance system, as shown in FIGS. 1B and 2 (i.e., only includes a first section 13A). In such examples, the gate may be attachable, or connected, to an existing post 30*b* in a fencing system, or may remain freestanding. When freestanding, the gate would include the stanchion 14 as shown in FIG. 2, having the plurality of rails 16 attached thereon. When attached directly to an existing post 30*b*, the plurality of rails 16 may be connected via pivot points 20*a* and connection means formed in/on the post 30*b*.

As shown in FIGS. 1A, 1B, and 2, the gate 100 may include a single gate portion 12A. The gate portion 12A may include a latch system 500 at a distal end of the gate portion 12A, such as on a post 18 of the gate portion 12A, as shown in FIG. 2. The latch 500 may include means to secure the gate 100 in a closed position to a post 30*a* which is spaced apart from the stanchion 14 and engaged perpendicular to the ground 38. The post 30*a* may be included as part of the gate 100, or may be a portion of an existing fencing system.

Also shown in FIGS. 1A, 1B, and 2 is a foot 17 positioned at a distal end of the gate portion 12A which supports the gate portion 12A at a predetermined position above the ground 38 when the gate 100 is in the closed position. For example, the foot 17 may position the rails 16 generally parallel with the ground 38 when the gate 100 is in a closed position. A length of the foot 17 may be adjustable to accommodate a variable level of the ground 38 beneath the gate portion 12A, and/or to accommodate a different positioning of the rails 16 with respect to the stanchion 14. Adjustment may be accomplished by any means known in the art such as, for example, a height adjustable screw.

The gate 100 may also include a lift system 300, which provides assistance so that only minimal manual power is necessary to lift the gate portion 12A into the vertical position (i.e., open). The lift system 300 may include a translating device and a projection, wherein the translating device provides a pulling force to rotate the swing arms from the horizontal position to the vertical position, and the projection guides the translating device along a path between the stanchion 14 and the gate portion 12A.

The lift system 300 may include a translating device comprising at least a tensioning element to provide the pulling force, and a flexible element to transmit the pulling force. According to one exemplary embodiment of the lift system, and with reference to FIGS. 1A, 1B, 2, and 3, the tensioning element may be a spring 46 attachable to the stanchion 14, such as at or near a top end of the stanchion 14, or on an extension 47 positioned at a top portion or top end of the stanchion 14. The spring 46 may be an extension spring and may thus include hooks at either end that provide a means for attachment. For example, the spring 46 may be attached to the extension 47 via a hook 46*a* at an end of the spring 46.

Figure 3:
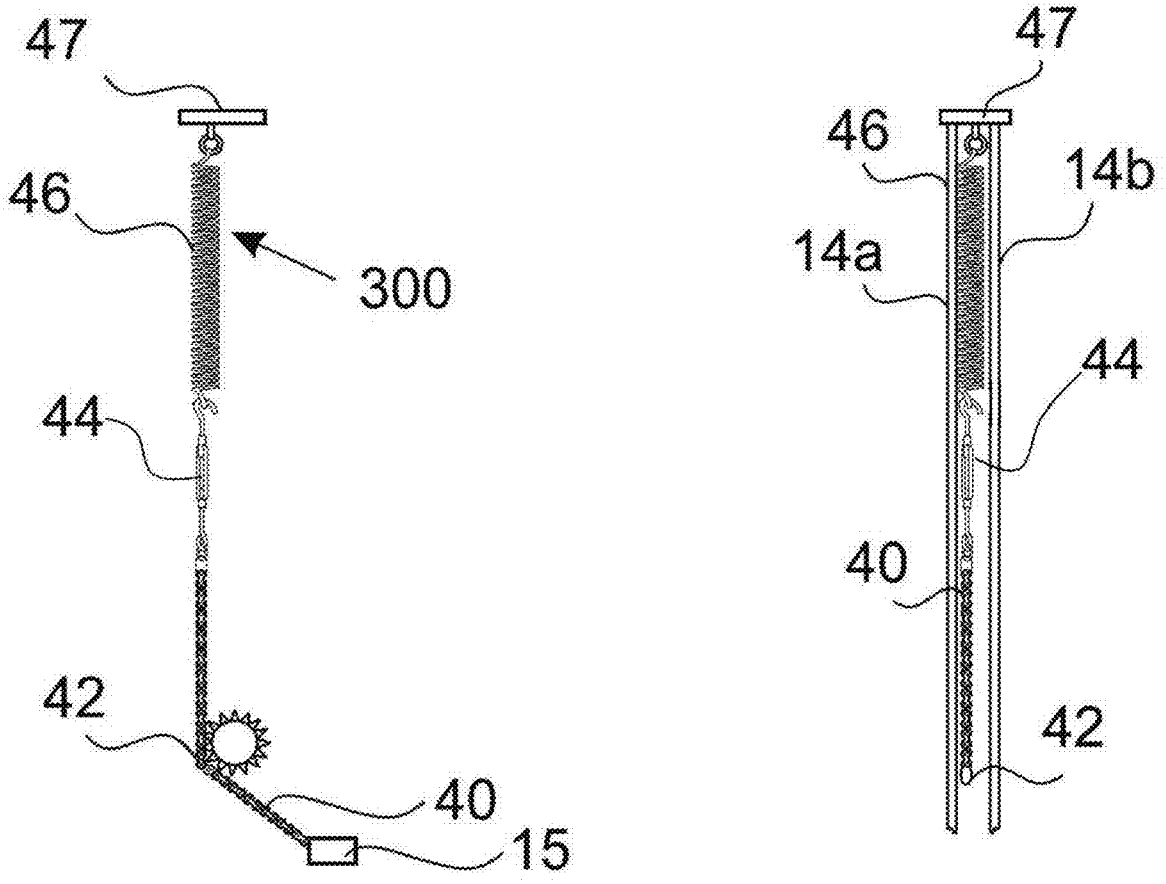
FIG. 3 illustrates a lift system for a gate according to various embodiments of the invention disclosed herein.

The flexible element may be a chain 40 or other flexible member attachable to one of the rails 16, such as to a top rail 16*a* at an attachment point 15 (see also FIG. 3). The flexible element may be attached directly to the tensioning element (e.g., the spring 46 may be attached directly to the chain 40 via a hook on the spring 46, see FIG. 3).

The lift system 300 may include a projection (e.g., sprocket 42) attached to the stanchion 14 and configured to engage the flexible element. The projection assists in guiding the flexible element along a path between the stanchion 14 and the rails 16. The unique placement of the projection on the stanchion 14 improves transmission of the pulling force from the tensioning element to the gate portion 12A, and enables the placement of the attachment point 15 to be more proximal on the gate portion 12A (i.e., closer to the stanchion 14).

In an exemplary embodiment where the flexible element is a chain 40, the projection may be a sprocket 42 attached to the stanchion 14 and configured to engage the chain 40. Thus, the spring 46 provides a pulling force on the chain 40 that is transmitted along a path that engages the sprocket 42 and ends with an attachment point on the rails 16 of the gate portion 12A. The pulling force acts to assist in rotation of the rails 16 from the horizontal position to the vertical position (lessen the perceived weight of the gate portion 12A when lifted to open the gate 100). Other exemplary flexible elements include at least a belt or rope which may engage a projection such as a pulley wheel.

With continued reference to FIGS. 1A, 1B, 2, and 3, the translating device of the lift system 300 may further include an adjustment element to provide a means to adjust the pulling force exerted on the gate portion 12A. An exemplary adjustment element includes a turnbuckle 44. In certain examples, the turnbuckle 44 may be attached to, and between, the tensioning element (e.g., spring 46) and the flexible element (e.g., chain 40) of the lift system 300. That is, the spring 46 having a hook at each end may be attached to the extension 47 via the hook at one end of the spring 46, and to the turnbuckle 44 via the hook at the other end of the spring 46. The turnbuckle 44 may be attached to the chain 40, which is in turn attached to a top of gate portion 12A via an attachment point 15. Rotation of the turnbuckle 44 may increase or decrease the tension on the spring 46, and may thus increase or decrease the pulling force exerted on the gate portion 12A.

In certain other examples, the position of the adjustment element may be varied within the translating device of the lift system 300. For example, when the adjustment element is a turnbuckle 44, a first end of the turnbuckle 44 may be attached to the stanchion 14, such as attached to the extension 47 on the stanchion, and a second, opposite end may be attached to the spring 46.

While the translating device of the lift system 300 has been described as including a tensioning element, a flexible element, and an adjustment element, additional elements are also possible and within the scope of the present invention. For example, additional flexible elements, such as chains, ropes, belts, etc., may be included at any point in the lift system to allow for varied positioning and sizes of the tensioning element (e.g., spring 46) and the adjustment element (e.g., turnbuckle 44). Moreover, the pulling force provided by the lift system 300 may be varied depending on the size and weight of the gate, and the amount of pulling force desired by a user of the gate. Beyond changing the pulling force by adjustment of the adjustment element (e.g., turnbuckle 44), variation of the pulling force may be achieved by changing any or all of: the amount of tension provided by the tensioning element (e.g., size and/or length of the spring 46), the position of the attachment point 15 of the lift system to the rails 16, the position of the attachment point of the lift system to the stanchion 14 (e.g., extension 47), the position of the projection (e.g., sprocket 42) on the stanchion 14 and the point at which it may engage the flexible element.

Figure 10:
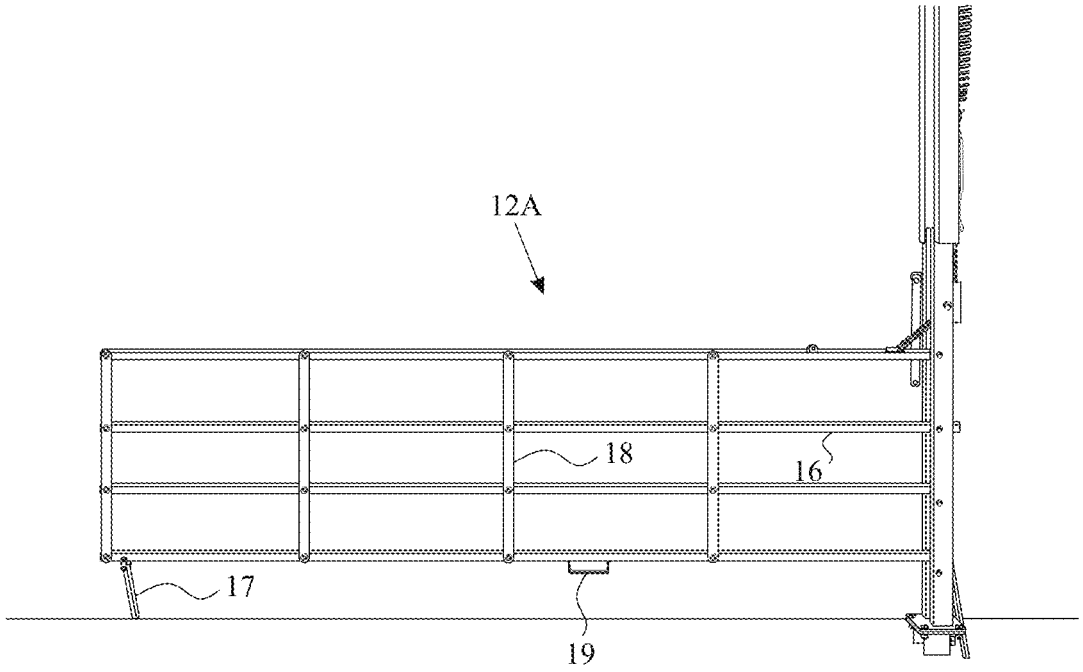
FIG. 10 illustrates the gate shown in FIG. 2 in a closed position.

A handle 19 may be included on the gate portion 12A, as shown in FIG. 10. The handle 19 as shown in FIGS. 1A, 1B and 2 may provide means for a user to apply force to the gate portion 12A when it is in the open position. Also shown in FIG. 12 is the foot 17 partially folded toward the rails 16. Not shown in the figures is a housing that may be attached to the gate 100, such as on the stanchion 14, that may enclose the lift system 300. The housing may provide an improved aesthetic appearance for the gate 100, may protect the lift system 300 from the elements, and/or may protect a user from dangers associated with inadvertent interaction with the lift system 300.

Figure 11:
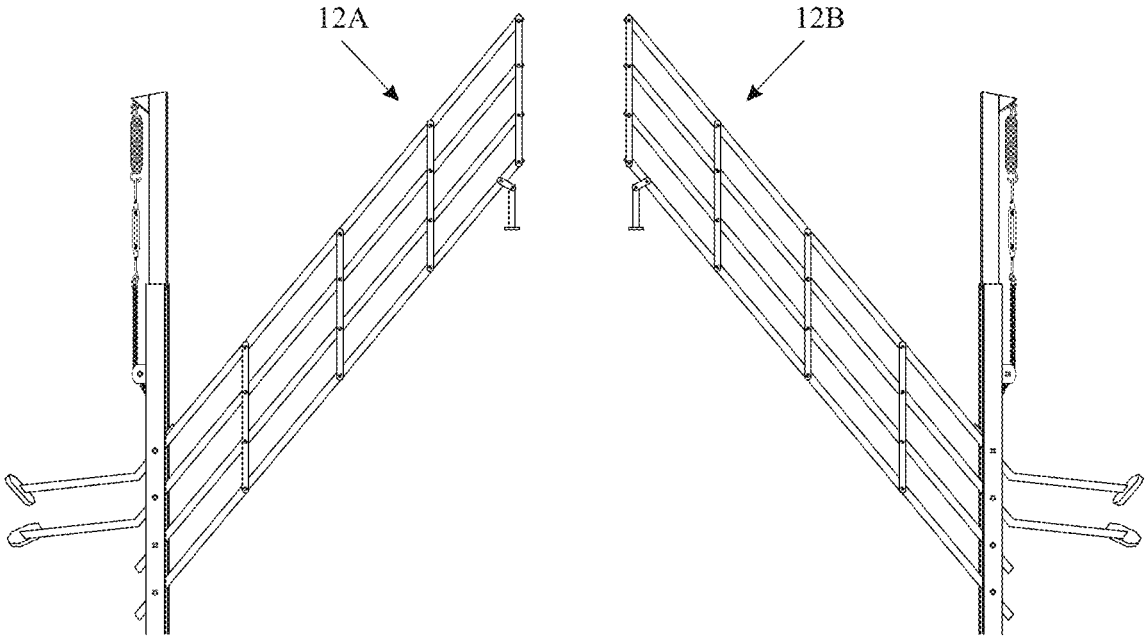
FIG. 11 illustrates the gate shown in FIG. 1A in the partially open position.

In combination with a counterweight system, such as shown in FIG. 1A, and described above, the lift system 300 of the presently disclosed gate may solve certain of the aforementioned problems of swing-style gates by providing a gate that opens in a vertical direction, perpendicular to the direction of travel through the gate, with a smooth and easy motion (see FIGS. 10-12 which depict the gate closed, partially opened, and fully opened, respectively). The spring 46 may provide enough lift assistance to make only minimal manual power necessary, while the chain 40 and sprocket 42 provide a mechanism that may be more durable to weathering, more consistent in alignment, and/or easier to maintain than prior art systems, such as those using a cable and pulley. Including an adjustment element, such as the turnbuckle 44, allows for tension adjustment. Moreover, the accordion style gate portion saves space in the open position, as the rails and posts fold when in the open position to a compact profile.

As shown in FIG. 11, the gate may include two stanchions and two gate portions (12A and 12B). The gate may further include two lift systems, and/or two counterbalance systems, with one attached to each stanchion or gate portion (12A, 12B), respectively. In FIG. 11, the gate is shown in a partially open position.

Figure 9:
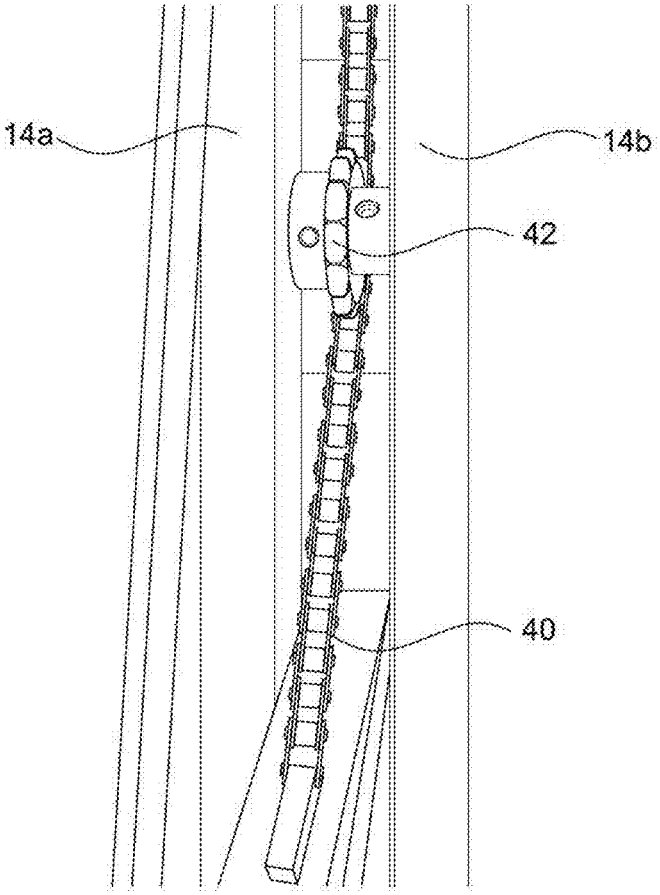
FIG. 9 illustrates a lift system for a gate according to various embodiments of the invention disclosed herein.

According to certain aspects of the present invention, all or at least a portion of the stanchion 14 may comprise two upright stanchions. For example, as shown in FIG. 3, a middle or lower portion of the stanchion 14 includes two upright stanchions (14*a*, 14*b*). The plurality of rails 16 may pass between, and be attached to, the two upright stanchions (14*a*, 14*b*). FIG. 9 depicts the positioning of the sprocket 42 between the two upright stanchions (14*a*, 14*b*), and FIG. 3 illustrates that an upper portion of the stanchion 14 may comprise a single post positioned between the two upright stanchions (14*a*, 14*b*) of a middle portion the stanchion 14.

Figure 5A:
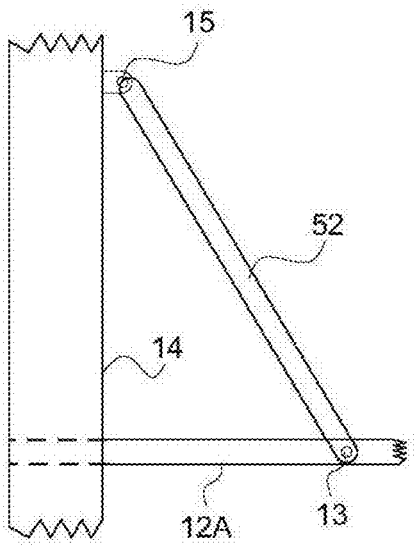
FIG. 5A illustrates a lock peg and bracket for a gate according to various embodiments of the invention disclosed herein.
Figure 5B:
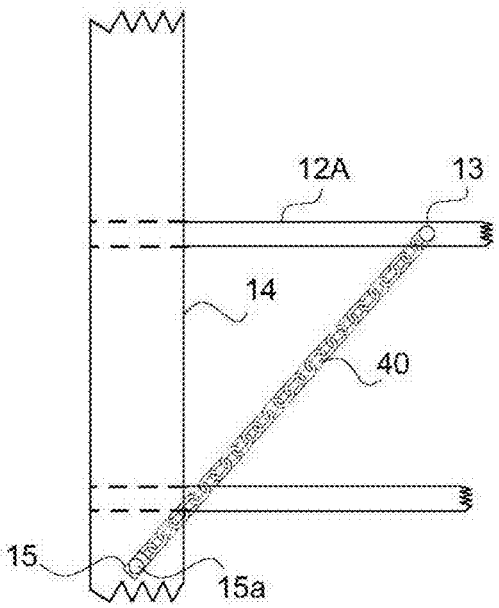
FIG. 5B illustrates a lock peg and chain for a gate according to various embodiments of the invention disclosed herein.

With reference to FIGS. 5A and 5B, a gate may include a lock peg 21 connecting the stanchion 14 to the top of gate portion 12A. According to certain aspects, as shown in FIG. 5A, a swinging lock bracket 52 may be attached at one end to a lock peg 21 affixed to the top of gate portion 12A and on the other end to a fixture on the stanchion 14. According to certain aspects, as shown in FIG. 5B, the top of gate portion 12A may be connected by a chain 40 to a lower portion of the stanchion 14. The chain may be fixed to the lock peg 21 on the top of gate portion 12A as well as to a fixture 15*a* on the stanchion 14.

Figure 4:
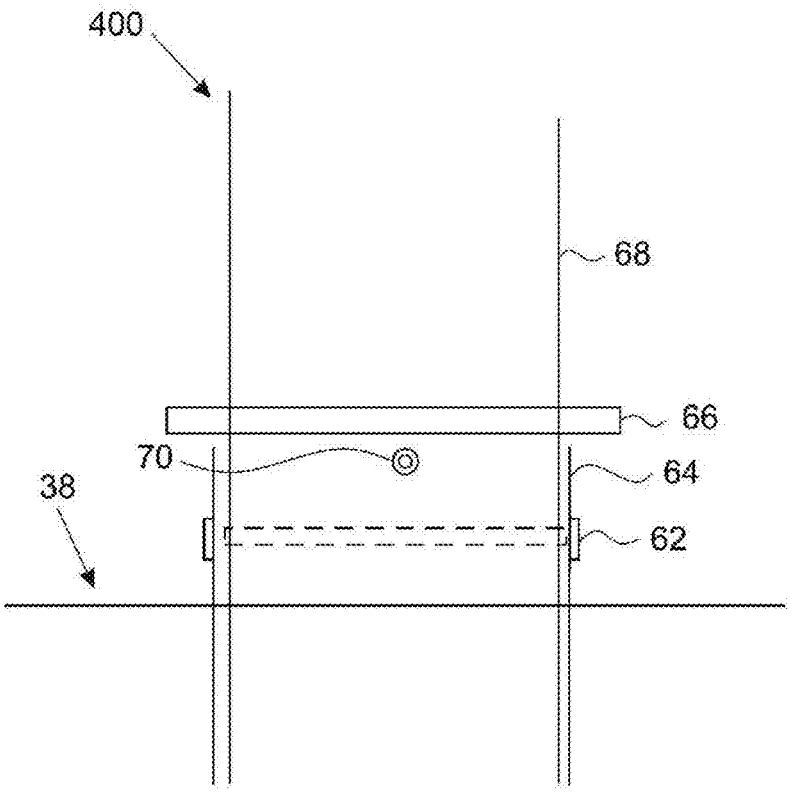
FIG. 4 illustrates a ground attachment mechanism for a gate according to various embodiments of the invention disclosed herein.

Alternatively, and with reference to FIGS. 1A, 1B and 4, the ground anchor system 400 may include a first cylindrical element 68 securely attached to a bottom end 22 of the stanchion 14, and a second cylindrical element 64 at least partially position within the ground 38. The first cylindrical element 68 may include a collar 66 that projects radially outward from an outer surface thereof. The second cylindrical element 64 may be sized and configured to rotatably accept the first cylindrical element 68 therein, wherein the collar 66 of the first cylindrical element 68 extends beyond an outer edge of the second cylindrical element 64 and maintains the first cylindrical element 68, and thus the stanchion 14, at a predetermined distance from a ground level 38. Moreover, the collar 66 maintains the stanchion 14 at a level position, and thus maintains the gate portion 12A at a level position.

The ground anchor system 400 of the gate 100 allows horizontal opening of the gate by axial rotation of the plurality of rails 16 about the stanchion 14, and thus provides a means to convert the vertical-style gate to a swing-style gate. In the event that the gate is damaged in a way that would prevent rotation of the rails 16 and posts 18 about the pivot points 20, or rotation of the rails 16 about the pivot points 20*a* on the stanchion 14, and thus prevent folding of the gate when opened vertically, the gate may be opened using the ground anchor system 400 which rotates the stanchion 14 within a cylindrical element 64. A pin 62 prevents rotation of the cylinders during normal operation and can be removed for conversion to a swing-style gate. A set screw prevents shifting of the inner cylinder within the outer cylinder during normal operation and can be removed for conversion to a swing-style gate.

According to certain aspects, the ground anchor system 400 may include a locking system that prevents rotation of the second cylindrical element 68 within the first cylindrical element 64. With reference to FIG. 4, the locking system may comprise a pin 62 which transverses both the first and second cylindrical elements (64, 68, respectively) so that they may not rotate with respect to each other. The pin 62 may be locked into position with a lock 70. The user may leave the pin 62 and lock 70 in place during normal operation of the gate for security reasons, and may remove the lock 70 and pin 62 if the accordion style frame is damaged and vertical lifting of the gate portion 12A becomes difficult or impossible.

According to certain aspects, the gate may include a latch system 500 as shown in FIG. 2. The latch may be controlled remotely, and may be configured to maintain the plurality of swing arms in the horizontal position when the latch is engaged. In certain examples, the tension of the tensioning element (e.g., spring 46) in the lift system 300 may be increased, such as by the adjustment element (e.g., turnbuckle 44), to bias the gate portion 12A to the open position. Thus, when the latch is opened, the gate may lift to the open position without further assistance.

Figure 6:
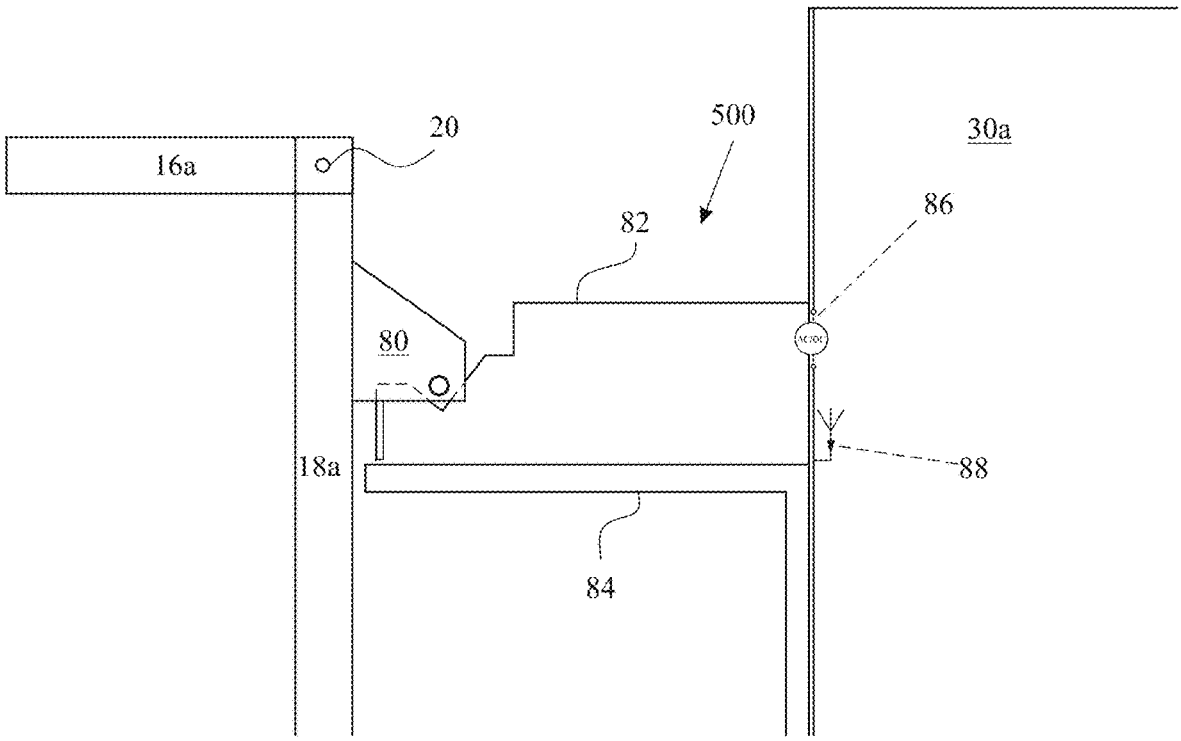
FIG. 6 illustrates a remote controlled latch for a gate according to various embodiments of the invention disclosed herein.

With reference to FIG. 6, the latch system 500 may include a gate mounted latch element 80 attachable on a distal end of the gate portion 12A, such as on a distal post 18*a*, and a post mounted latch element 82. In FIG. 6, the post mounted element 82 is shown as mounted on a post 30 of an existing fencing system by attachment to a mounting plate 84. In certain example, the latch system 500 may be an electromagnetic latch system, and the gate mount element 82 may include wiring to a power source 86, such as a solar element, and/or wiring to a remote receiver 88. The remote receiver allows a user to remotely activate the latch system 500.

Figure 7:
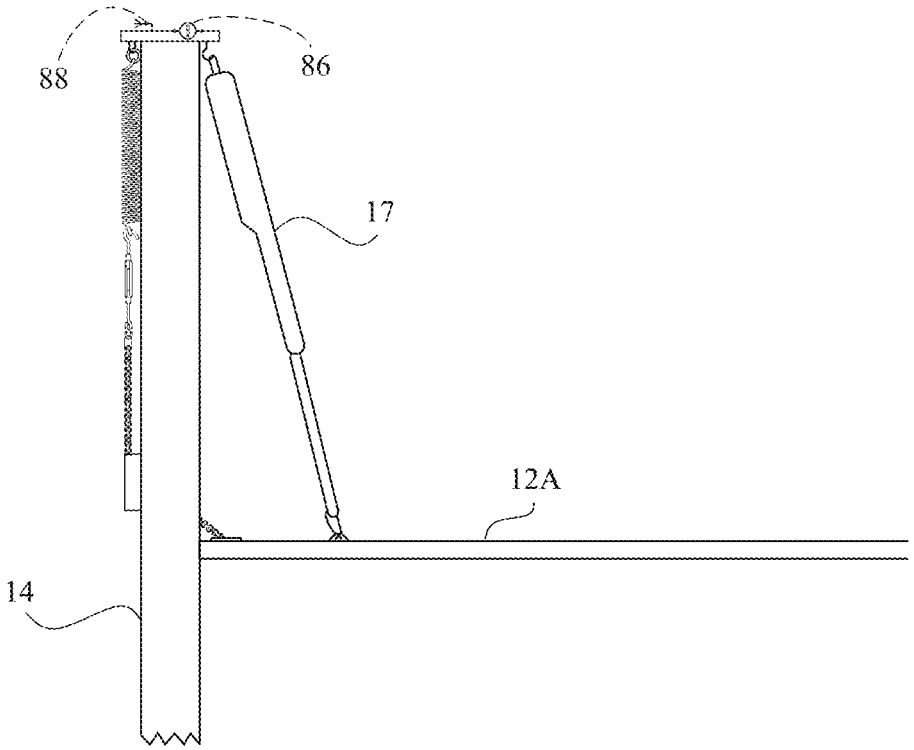
FIG. 7 illustrates an automatic opener for a gate according to various embodiments of the invention disclosed herein.
Figure 8:
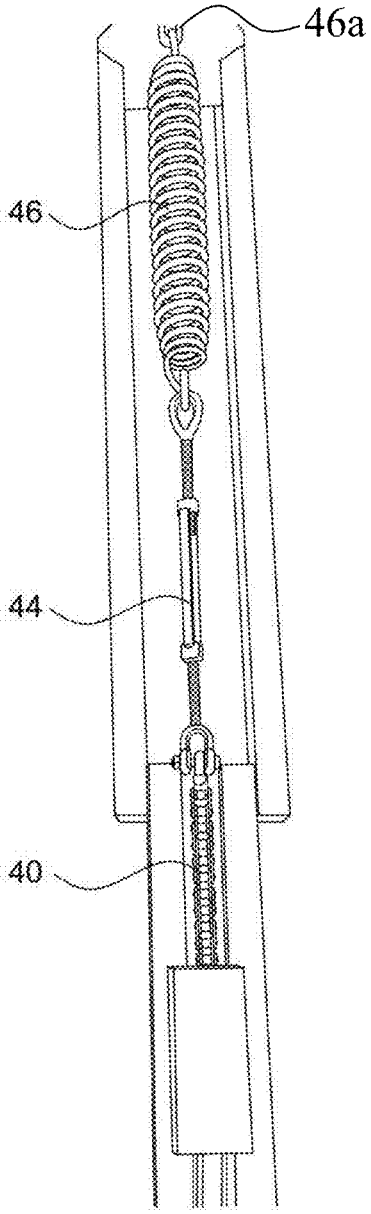
FIG. 8 illustrates a lift system for a gate according to various embodiments of the invention disclosed herein.

According to certain aspects, as shown in FIG. 7, an automatic opener 91 may be attached to the top portion of the gate portion 12A and the top portion of the stanchion 14. The automatic opener may electrically connect to a power source 86, such as a solar element, and/or may be wired to a remote receiver 88. The automatic opener 91 permits the gate to open without any manual lifting. In such an embodiment, the lift system 300 reduces the workload of the automatic opener 91 and provides a backup lift mechanism if the automatic opener 91 fails, at which point the automatic opener 91 can be detached from the top of gate portion 12A.

The gate may include a mechanism to prevent the opening of the gate by locking to the top of gate portion 12A a bracket or chain attached to the stanchion 14. The gate may include a latch system 500 that is remotely controlled to hold the gate portion 12A in a closed position. When activated, the remotely controlled latch may permit the gate portion 12A to open automatically and without manual lifting.

While a specific type of latching system has been described herein, others known in the art are within the scope of the present invention. Moreover, while the post 30*a* has been indicated to be part of an existing fencing system, in certain examples the post 30*a* may be considered to be part of the gate of the present invention.

The gates disclosed herein may find use to control access for a roadway, walkway, driveway, pathway, or any space used for passage from one place to another.

The following aspects are disclosed in this application:

Aspect 1. A gate comprising: a gatepost having a top end and a bottom end of the gatepost is attachable to a connection plate positioned at ground level; a plurality of swing arms comprising a first section and a second section, the second section offset from the first section and pivotally connected to the gatepost, wherein the second section comprises one or more segments hingedly attached in series; and a lift system comprising a translating device in communication with a sprocket, wherein the lift system provides a force to rotate the plurality of swing arms from a horizontal position to a vertical position and the one or more segments of the second section from an open position to a closed position, wherein the translating device comprises a first end including a spring fixedly connected proximate the top end of the gatepost, a second end including a chain fixedly connected to one of the plurality of swing arms, and a middle portion comprising a turnbuckle positioned between and connected to the first end and the second end of the translating device.

Aspect 2. The gate of aspect 1, wherein the force provided by the lift system is adjustable.

Aspect 3. The gate of aspect 1 or 2, wherein the sprocket is fixedly attached to the gatepost.

Aspect 4. The gate of aspect 2 or 3, wherein rotation of the turnbuckle increases or decreases the force provided by the lift system.

Aspect 5. The gate according to any one of the aspects 1 to 4 comprising a housing attachable to the gatepost and configured to enclose the lift system.

Aspect 6. The gate according to any one of the aspects 1 to 5, wherein the first section of at least one of the plurality of swing arms comprises a counterbalance weight.

Aspect 7. The gate according to any one of aspects 1 to 6, wherein the counterbalance weight is positioned at an end of the first section of the swing arm distal from the second section thereof.

Aspect 8. The gate according to any one of aspects 1 to 7, wherein the gatepost comprises two upright stanchions, and the plurality of swing arms are connected therebetween.

Aspect 9. The gate according to any one of aspects 1 to 8, wherein the sprocket is fixedly attached between two upright stanchions.

Aspect 10. The gate according to any one of aspects 1 to 9 comprising a first cylindrical element securely attached to the bottom end of the gatepost, and comprising a collar that projects radially outward from an outer surface thereof, and a second cylindrical element secured below ground level and sized to rotatably accept the first cylindrical element therein, wherein the collar of the first cylindrical element extends beyond an outer edge of the second cylindrical element and maintains the gatepost at a predetermined distance from a ground level, wherein the ground anchor system provides horizontal rotation of the plurality of swing arms.

Aspect 11. The gate according to any one of aspects 1 to 10, wherein the ground anchor system further comprises a locking system that prevents rotation of the second cylindrical element within the first cylindrical element.

Aspect 12. The gate according to any one of aspects 1 to 11, wherein the locking system comprises a pin which transverses both the first and second cylindrical elements.

Aspect 13. The gate according to any one of aspects 2 to 12 comprising a remote controllable latch configured to maintain the plurality of swing arms in the horizontal position when the remote controllable latch is engaged, wherein the force provided by the lift system biases the plurality of swing arms to the vertical position.

Aspect 14. A gate comprising a stanchion; a plurality of rails pivotally connected to the stanchion and comprising a plurality of posts hingedly attached thereto; and a lift system comprising a translating device in communication with a sprocket, wherein the lift system provides an adjustable force to rotate the plurality of rails from a horizontal position to a vertical position, wherein the lift system provides a force to rotate the plurality of rails from the horizontal position to the vertical position; a ground anchor system comprising a first cylindrical element securely attached to the bottom end of the stanchion and comprising a collar that projects radially outward from an outer surface thereof, and a second cylindrical element sized to rotatably accept the first cylindrical element therein, wherein a portion of the second cylindrical element is secured below a ground level and the collar of the first cylindrical element extends beyond an outer edge of the second cylindrical element and maintains the stanchion at a predetermined position within the second cylindrical element, wherein the ground anchor system provides axial rotation of the plurality of rails about the stanchion; wherein the translating device comprises a first end including a spring fixedly connected to the stanchion; a second end including a chain fixedly connected to one of the plurality of rails; and a middle portion comprising a turnbuckle positioned between and connected to the first end and the second end of the translating device, wherein hinged attachment of the plurality of posts allows the plurality of posts to fold substantially parallel with the plurality of rails when the plurality of rails are in the vertical position.

Aspect 15. The gate of aspect 14, wherein the ground anchor system further comprises a locking system that prevents rotation of the second cylindrical element within the first cylindrical element.

Aspect 16. The gate of aspect 14 or 15, wherein the first end of the translating device is connected proximate a top end of the stanchion.

Aspect 17. The gate according to any one of aspects 14 to 16, wherein the stanchion comprises two upright stanchions, and the plurality of rails and the sprocket are connected therebetween.

Aspect 18. The gate according to any one of aspects 14 to 17, wherein a first end of at least one of the plurality of rails comprises a counterbalance weight.

Aspect 19. The gate according to any one of aspects 14 to 18, wherein the second end of the translating device is connected to a top one of the plurality of rails.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art with respect to the systems and methods described herein.

While particular exemplary embodiments of gates and methods of making and using the same have been illustrated and described, it would be obvious to those skilled in the art that various other changes and modifications can be made without departing from the spirit and scope of the invention. Those skilled in the art will recognize, or be able to ascertain using no more than routine experimentation, numerous equivalents to the specific devices and methods described herein, including alternatives, variants, additions, deletions, modifications and substitutions. This disclosure, including the claims, is intended to cover all such equivalents that are within the spirit and scope of this invention.

What is claimed is:

1. A gate comprising:

a stanchion;

a plurality of rails pivotally connected to the stanchion and a plurality of posts hingedly attached to at least one of the plurality of rails; and a lift system comprising a translating device in communication with a sprocket, wherein the lift system provides an adjustable force to rotate the plurality of rails from a horizontal position to an upward position;

a ground anchor system comprising a first cylindrical element attached to a bottom end of the stanchion and including a collar that projects radially outward from an outer surface thereof, and a second cylindrical element sized to rotatably receive the first cylindrical element therein, wherein a portion of the second cylindrical element is positioned below a ground level and the collar of the first cylindrical element extends beyond an outer edge of the second cylindrical element and contacts a top surface of the second cylindrical element to maintain the first cylindrical element at a predetermined position within the second cylindrical element, wherein the ground anchor system is configured to enable the plurality of rails to rotate about a longitudinal axis of the stanchion;

wherein the translating device comprises a first end including a spring fixedly connected to the stanchion;

a second end including a chain fixedly connected to one of the plurality of rails; and a middle portion comprising a turnbuckle positioned between and connected to the first end and the second end of the translating device, wherein the plurality of posts are substantially parallel with the stanchion when the at least one of the plurality of rails to which the plurality of posts is hingedly attached is in the upward position.

2. The gate of claim 1, wherein the ground anchor system further comprises a locking system that is adapted to prevent rotation of the first cylindrical element within the second cylindrical element.

3. The gate of claim 2, wherein the locking system comprises a pin which transverses both the first and second cylindrical elements.

4. The gate of claim 1, wherein the first end of the translating device is connected to the stanchion proximate a top end of the stanchion.

5. The gate of claim 1, wherein the stanchion comprises two upright stanchions, and the plurality of rails and the sprocket are disposed therebetween.

6. The gate of claim 5, wherein the sprocket is fixedly attached to the two upright stanchions.

7. The gate of claim 1, wherein an end of at least one of the plurality of rails comprises a counterbalance weight.

8. The gate of claim 7, wherein the counterbalance weight is positioned at an end of an extension attached to the end of the at least one of the plurality of rails.

9. The gate of claim 1, wherein the one of the plurality of rails to which the chain is fixedly connected is a top of one of the plurality of rails.

10. The gate of claim 1, wherein the sprocket is fixedly attached to the stanchion.

11. The gate of claim 1, wherein rotation of the turnbuckle increases or decreases the force provided by the lift system.

12. The gate of claim 1 comprising a housing attachable to the stanchion and configured to enclose the lift system.

13. The gate of claim 1 comprising a remote controllable latch configured to maintain the plurality of rails in the horizontal position when the remote controllable latch is engaged, wherein the force provided by the lift system biases the plurality of rails to the upward position.

* * * * *